US006460250B1

(12) United States Patent
Amborn et al.

(10) Patent No.: US 6,460,250 B1
(45) Date of Patent: Oct. 8, 2002

(54) PROCESS FOR PRODUCING A TUBULAR STRUCTURAL ELEMENT

(75) Inventors: Peter Amborn, Neunkirchen (DE); Simon Jonathan Giles Griffiths, Telford (GB)

(73) Assignee: Dr. -Ing Peter Amborn (DE)

( * ) Notice: Subject to any disclaimer, the term of this patent is extended or adjusted under 35 U.S.C. 154(b) by 0 days.

(21) Appl. No.: 09/286,734

(22) Filed: Apr. 6, 1999

(51) Int. Cl.[7] ..... B21D 53/88

(52) U.S. Cl. ..... 29/897.2; 29/421.1; 29/516; 29/523

(58) Field of Search ..... 29/897.2, 421.1, 29/516, 523, 897, 514, 522.1; 72/370.02, 370.03, 370.06; 180/311; 280/798, 796; 296/203, 204, 205; 285/382.2, 382.1; 403/285, 279, 282

(56) References Cited

U.S. PATENT DOCUMENTS 4,286,372 A * 9/1981 Batcheller ..... 29/516
4,327,471 A * 5/1982 Whitted, III ..... 29/516
4,330,924 A * 5/1982 Kushner et al. ..... 29/516
4,359,812 A * 11/1982 Haag et al. ..... 29/516
4,567,743 A * 2/1986 Cudini ..... 72/61
4,759,111 A * 7/1988 Cudini ..... 29/523
5,016,925 A * 5/1991 Davis ..... 29/516
5,333,775 A 8/1994 Bruggerman et al.
5,491,883 A * 2/1996 Marlinga ..... 29/421.1
5,664,327 A * 9/1997 Swars ..... 29/421.1
5,735,156 A * 4/1998 Yoshitomi et al. ..... 29/421.1
5,890,287 A * 4/1999 Fukaya ..... 29/516

* cited by examiner

*Primary Examiner*—S. Thomas Hughes
*Assistant Examiner*—T. Nguyen
(74) *Attorney, Agent, or Firm*—Kilpatrick Stockton LLP

(57) ABSTRACT

A process for forming an elongate structural element of desired shape being of large and small cross-sectional dimensions at spaced locations along its length, the process including the steps of:

(i) selecting a first tube for forming a first selected length of the element having cross-sectional dimensions within a first range of relatively small cross-sectional dimensions within the hydro-forming-elongation ratio capabilities of the material from which the first tube is formed, said first tube being of a first constant cross-sectional dimension along its length, (ii) selecting a second tube for forming a second selected length of the element adjacent to the first length, the second length of the element having cross-sectional dimensions within a second range of relatively large cross-sectional dimensions within the hydro-forming elongation ratio capabilities of the material from which the second tube is formed, said second tube being of a second constant cross-sectional dimension along its length which is different to said first constant cross-sectional dimension, (iii) joining adjacent ends of said first and second tubes together, and (iv) performing forming operations on the first and second tubes to produce the desired shape of the element.

15 Claims, 3 Drawing Sheets

PROCESS FOR PRODUCING A TUBULAR STRUCTURAL ELEMENT

FIELD OF THE INVENTION

The present invention relates to a process for producing a tubular structural element, and to a tubular structural element which is particularly, but not exclusively, suitable for use in the construction of vehicles.

BACKGROUND OF THE INVENTION

In the construction of vehicles, tubular structural elements are widely used which are of complex shape and cross-sectional dimensions vary widely along their length. Examples of such elements in an automobile are the A-pillar, the B-pillar, or the instrumentation panel beam.

These elements are usually formed into final shape from a tube which prior to the forming process is of constant cross-section. The forming process is carried out in a die and utilises cold or warm fluid pressure forming. Forming tubes into desired shapes using a fluid medium which is supplied internally of the tube under pressure is known. The medium may be small solid balls which collectively act as a fluid, or may be a liquid such as a suitable oil or may be a gas such as air or steam. In this specification the, forming process performed within a die and which utilises a pressurised fluid medium is referred to as a hydro-forming process. The hydro-forming process may be performed using a warm or cold die and/or tube. The hydro-forming process is restricted by the hydro-forming-elongation ratio of the material from which the tube is made and so with a single tube it is only possible for the maximum and minimum cross-sectional dimensions of the final shape of the element to differ by twice the hydro-forming-elongation ratio of the material.

In the present specification the term 'hydro-forming-elongation ratio' of a material is the amount by which the material can be elongated under the conditions of hydro-forming processes.

BRIEF SUMMARY OF THE INVENTION

It is a general aim of the present invention to provide a process for forming, preferably using cold or warm hydro-forming techniques, a tubular structural element having maximum and minimum cross-sectional dimensions which can differ by more than twice the hydro-forming-elongation ratio of the material from which the element is made.

According to one aspect of the present invention there is provided a process for forming an elongate structural element of desired shape being of large and small cross-sectional dimensions at spaced locations along its length, the process including the steps of:

(i) selecting a first tube for forming a first selected length of the element having cross-sectional dimensions within a first range of relatively small cross-sectional dimensions within the hydro-forming-elongation ratio capabilities of the material from which the first tube is formed, said first tube being of constant wall thickness and of a first constant cross-sectional dimension along its length, (ii) selecting a second tube for forming a second selected length of the element adjacent to the first length, the second length of the element having cross-sectional dimensions within a second range of relatively large cross-sectional dimensions within the hydro-forming-elongation ratio capabilities of the material from which the second tube is formed, said second tube being of constant wall thickness and being of a second constant cross-sectional dimension along its length which is different to said first constant cross-sectional dimension, (iii) joining adjacent ends of said first and second tubes together, and (iv) performing forming operations on the first and second tubes to produce the desired shape of the element.

If desired, step (iv) may be performed before step (iii).

Preferably said first and second constant cross-sectional dimensions respectively lie outside said second and first ranges of cross-sectional dimensions, and joining of said first and second tubes includes the steps of:

(v) enlarging one end of the first tube to form a first connection formation of greater cross-sectional dimension than said first constant cross-sectional dimension, and/or (vi) reducing one end of the second tube to form a second connection formation of lesser cross-sectional dimension than said second constant cross-sectional dimension, (vii) joining the first and second connection formations together to join said first and second tubes together.

Step (v) and/or step (vi) may be performed using any conventional cold or hot deforming technique, including swaging, drawing or hot or cold hydro-forming.

The first and second connection formations may be fixedly joined together by bonding techniques such as welding.

Alternatively or in addition, the first and second connecting formations may be formed so as to have overlapping marginal end portions which are fixedly secured together by a forming operation which causes the overlapping marginal end portions to be pressed together. Preferably relative axial movement between the marginal portions of the first and second connection portions is controlled as the respective marginal portions are pressed together. In this respect, the overlapping marginal-portions may be adapted by shaping so as to provide a mechanical lock therebetween resisting relative axial movement between the overlapping marginal portions.

Alternatively, or in addition, friction material may be located between the overlapping marginal portions in order to restrain relative axial movement therebetween.

It will be appreciated that the material of the first tube may be the same or different to the material of the second tube and may be of the same or different wall thickness.

The tubes may be symmetrical or asymmetrical in cross-sectional shape.

In accordance with another aspect of the present invention there is provided a process for forming an elongate structural element of desired shape being of large and small cross-sectional dimensions at spaced locations along its length, the process including the steps of:

(i) selecting a first tube for forming a first selected length of the element having cross-sectional dimensions within a first range of relatively small cross-sectional dimensions within the hydro-forming-elongation ratio capabilities of the material from which the first tube is formed, said first tube being of constant wall thickness and being of a first constant cross-sectional dimension along its length, (ii) selecting a second tube for forming a second selected length of the element adjacent to the first length, the second length of the element having cross-sectional dimensions within a second range of relatively large cross-sectional dimensions within the hydro-forming-elongation ratio capabilities of the material from which the second tube is formed, said second tube being of constant wall thickness and being of a second constant cross-sectional dimension along its length which is different to said first constant cross-sectional dimension, (iii) selecting an intermediate connection tube having a first end of relatively small cross-sectional dimension and a second end of relatively large cross-sectional dimension;

(iv) joining said first and second tubes together by connecting one end of the first tube to the first end of the connection tube and by connecting one end of the second tube to the second end of the connection tube, and (v) performing forming operations on the first, second and connection tubes to produce the desired shape of the element.

Preferably the connection tube is connected to the first and second tubes by welding.

Preferably the connection tube progressively increases in cross-sectional dimensions from its first end to its second end at a substantially constant rate along its length. In a preferred embodiment, the connection tube is in the form of a truncated cone.

BRIEF DESCRIPTION OF THE DRAWINGS

Various aspects of the present invention are hereinafter described, with reference to the accompanying drawings in which.

DETAILED DESCRIPTION OF PREFERRED EMBODIMENTS

Figure 1:
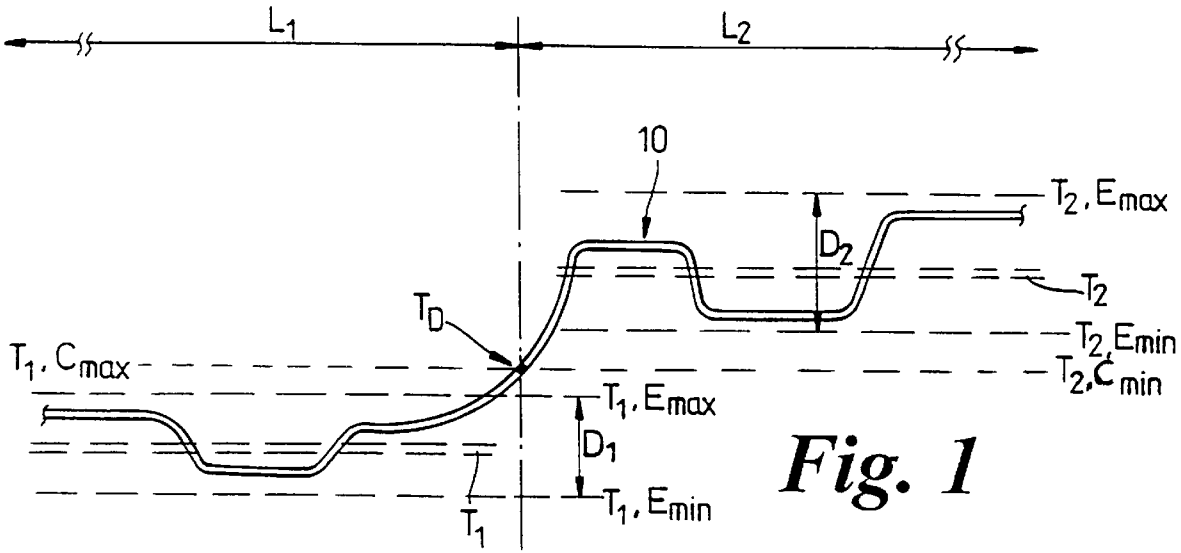
FIG. 1 is a schematic illustration of a longitudinal portion of a finished tubular structural element according to the present invention.

Referring initially to FIG. 1 there is shown a longitudinal wall portion of a tubular structural element 10.

The element 10 is divided into longitudinal sections $L_1$, $L_2$ wherein within section $L_1$ the cross-sectional dimensions of the element 10 vary within a first range of dimensions $D_1$ and wherein within section $L_2$ the cross-sectional dimensions of the element vary within a second range of dimensions $D_2$.

The element 10 is generally formed from tubes $T_1$ and $T_2$ which are joined end to end to form single element 10 which has continuous structural integrity along its length.

The element 10 is formed by deforming the material of the tubes $T_1$ and $T_2$ using cold or hot hydro-forming techniques and so relies upon the hydro-forming-elongation ratio capabilities of the materials of tubes $T_1$ and $T_2$ under the temperature conditions of the cold or hot hydro-forming process. The maximum and minimum cross-sectional dimensions which tube $T_1$ is capable of forming under these conditions is illustrated by lines $T_1$, $E_{max}$ and $T_1$, $E_{min}$ respectively and for tube $T_2$ are illustrated by lines $T_2$, $E_{max}$, and $T_2$, $E_{min}$ respectively.

As shown in FIG. 1, the tubes $T_1$, and $T_2$ are joined at a location $T_D$ and this location has to be chosen to occur at a longitudinal position along the element 10 whereat the following condition applies, viz the maximum cross-sectional dimension $T_1$, $C_{max}$ achievable by elongation of tube $T_1$ (by any conventional technique) is greater or equal to the minimum cross-sectional dimension $T_2$, $C_{min}$ achievable by elongation of tube $T_2$ (by any conventional technique).

In FIG. 1, $T_1$, $C_{max}$ is shown as being equal to $T_2$, $C_{min}$. However, as illustrated diagrammatically in FIG. 2, when $T_1$, $C_{max}$ is greater than $T_2$, $C_{min}$, then the greater the difference between $T_1$, $C_{max}$ and $T_2$, $C_{min}$ the longer the length zone $J_Z$ along which the joint $T_D$ may be selectively located.

Accordingly it is possible by analysing the variation of cross-sectional dimensions along the length of element 10 to identify length sections $L_1$, $L_2$, . . . etc. having cross-section dimensions varying within predetermined ranges and to select appropriate lengths of tubes $T_1$, $T_2$ etc. having predetermined elongation capabilities for forming corresponding length sections $L_1$, $L_2$ etc.

In order to form a single element 10 which has structural integrity along its length, it is necessary to join tubes $T_1$, $T_2$ end to end in a rigid manner at a location $T_D$.

Figure 3:
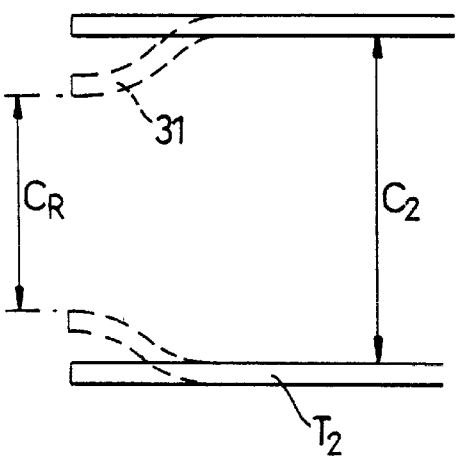
FIG. 3 is a schematic illustration showing first and second tubes for forming respective first and second lengths of the element in FIG. 1.

In a preferred embodiment, as illustrated in FIG. 3, the tube $T_1$ is of a constant cross-sectional dimension $C_1$ which is less than the minimum dimension $T_2$, $E_{min}$ of tube $T_2$ and tube $T_2$ is of a constant cross-sectional dimension $C_2$ which is greater than the maximum dimension $T_1$, $E_{max}$ of tube $T_1$. This is preferred since, in combination, such tubes $T_1$, $T_2$ enable a wide variation of cross-sectional dimensions to be achieved viz from the lower limit of $D_1$ to the upper limit of $D_2$ as in the case where $T_1$, $E_{max}$=$T_2$, $E_{min}$.

Accordingly, with this arrangement in order to join tubes $T_1$, $T_2$ together at least one end or preferably both respective ends of the tubes need to be deformed to create first and second connection formations 30, 31 respectively.

The connection formation 30 is formed by enlarging the end of tube $T_1$ to a cross-sectional dimension $C_E$ which is greater than its constant cross-sectional dimension $C_1$.

The connection formation 31 is formed by reducing the end of tube $T_2$ to a cross-sectional dimension $C_R$ which is less than its constant cross-sectional dimension $C_2$.

Deformation of tube $T_1$ and/or tube $T_2$ in order to form connection formations $C_1$, $C_2$ respectively may be achieved by any conventional techniques, eg. cold forming such as swaging or hot forging techniques. Accordingly the amount of deformation to achieve $C_E$ and/or $C_R$ may be such as to exceed to respective hydro-forming-elongation ratios of tubes $T_1$, $T_2$ respectively.

The cross-sectional dimensions $C_E$ and $C_R$ are chosen such that the connection formations 30, 31 may be joined to one another.

Figure 4:
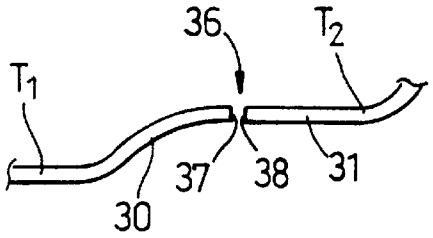

In this respect, $C_E$ and $C_R$ may be the same in order to define a butt joint 36 as illustrated in FIG. 4, the respective abutting ends 37, 38 of tubes $T_1$ and $T_2$ being bonded together by suitable bonding techniques such as welding or brazing.

Figure 5:
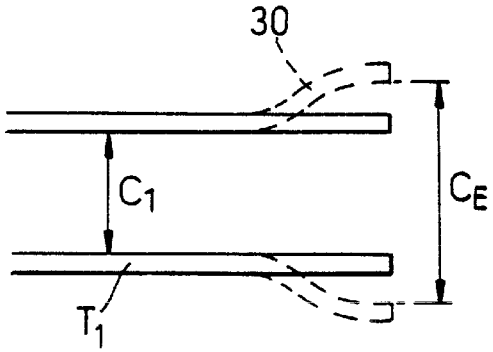
FIGS. 4, 5 and 6 schematically illustrate alternative configurations for joining the first and second connection formations.
Figure 5:
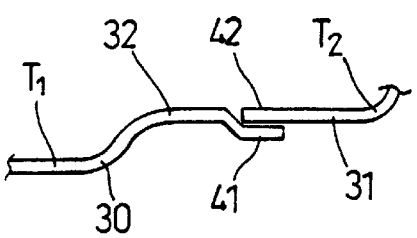
Figure 6:
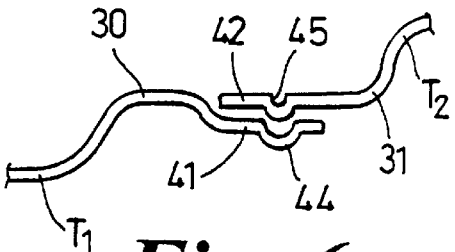

Alternatively as illustrated in FIGS. 5 and 6, the connection formations 30, 31 may be formed so as to have overlapping marginal end portions 41, 42 which in effect are telescopically engaged.

Overlapping end portions 41, 42 may provide a dry joint by expansion of the inner portion 41 into pressing contact with the outer portion 42 during the forming process for forming the final shape of the element 10 from tubes $T_1$, $T_2$.

Preferably the overlapping portions 41, 42 are controlled during this forming process so as to be restrained from relative axial movement. Accordingly, in the embodiment illustrated in FIG. 5, friction material is preferably located inbetween opposed faces of portions 41, 42.

In the embodiment of FIG. 6, the opposed faces of the portions 41, 42 are provided with one or more recesses 44 and co-operating ribs 45 respectively which after initial expansion of the inner portion 41 co-operate to form a mechanical lock to restrain relative axial movement. It will be appreciated however that friction material may also be provided between portions 41, 42 in embodiment of FIG. 6 if desired.

It is also envisaged that the overlapping portions 41, 42 may be secured together by riveting techniques, such as blind rivets.

In the above example, two tubes $T_1$, $T_2$ are described for forming a length portion of element 10. It will be appreciated that two tubes $T_1$, $T_2$ may be sufficient to form the entire length of element 10 or that additional tubes having different hydro-forming-elongation ratios capabilities to tubes $T_1$, $T_2$ may be incorporated.

In this respect, it will be appreciated that the choice of which tube should be located at a given location along the length of the element 10 can be influenced by the constant cross-sectional dimension of the tube and the material from which it is made.

For example it is envisaged that tubes of the same or different materials may be joined end to end. For example, the element 10 may be composed of deformed tubes made from steel and aluminium.

The forming process for deforming the tubes $T_1$, $T_2$ is preferably performed after joining of the tubes and is preferably cold or warm hydro-forming. It is envisaged that, if desired, one of the tubes $T_1$, $T_2$ may have a constant cross-section dimension $C_1$, or $C_2$ respectively which lies within the range of dimensions $D_1$ or $D_2$ of the other tube. In such a case it will be appreciated that the end of only one tube needs to be deformed in order to form a connection formation for connection to the end of the other tube.

It is also envisaged that deformation by hydro-forming may be performed on one tube only and that the other tube may be of constant cross-section along its length or deformed by other conventional techniques. If these tubes are to be joined as per the FIGS. 5 and 6 embodiments, then overlapping portions 41, 42 are preferably formed by a hydro-forming process.

It will be appreciated that the tubes $T_1$, $T_2$ may be of symmetrical or asymmetrical cross-sectional shape relative to their longitudinal axis.

It is also to be appreciated that the connection formations 30 and/or 31 may be formed so as to be symmetrical or asymmetrical relative to the longitudinal axis of the respective tubes $T_1$, $T_2$. Accordingly, after joining, the tubes $T_1$, $T_2$ may be co-axial or may have axes off-set to one another.

Figure 7:
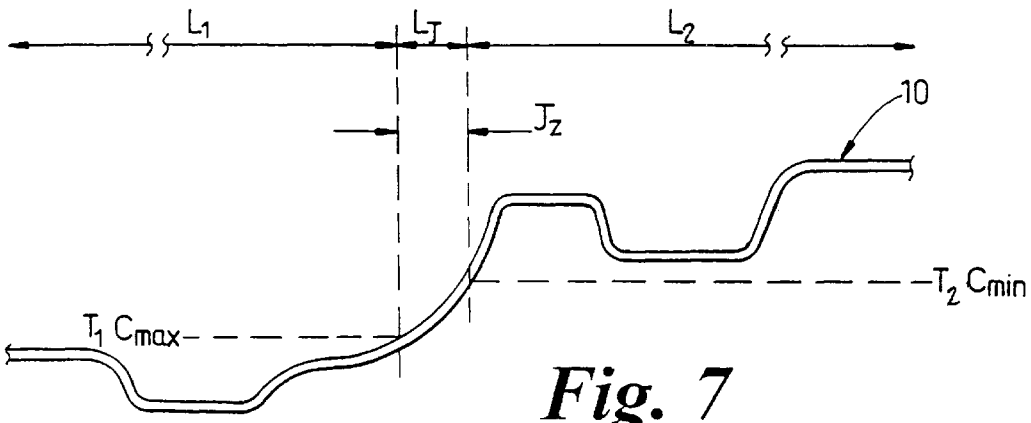
FIG. 7 is an illustration similar to FIG. 1 showing a different embodiment.
Figure 8:
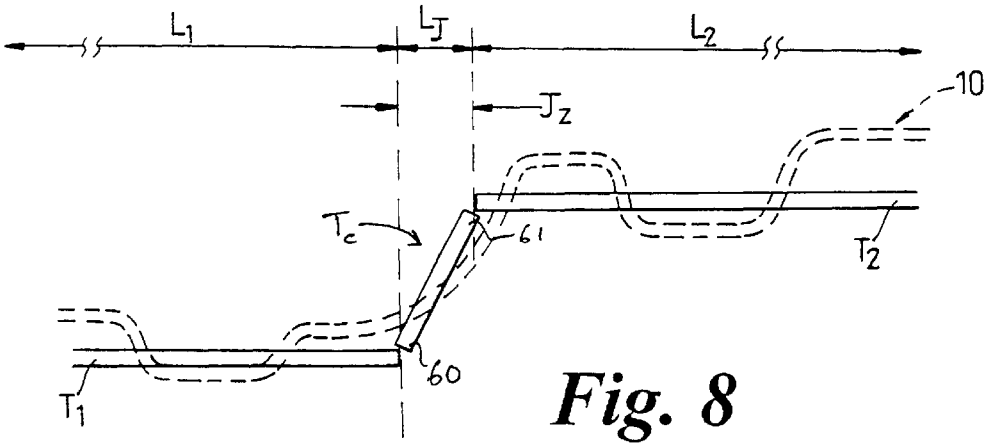
FIG. 8 is an illustration showing tubes prior to formation into the tubular element shown in FIG. 7.

A further embodiment is illustrated in FIGS. 7 and 8.

As illustrated in FIG. 7, the element 10 has two lengths $L_1$ and L2 formed from respective tubes $T_1$ and $T_2$. However the tubes $T_1$ and $T_2$ do not have the capability of being deformed such that $T_1\ C_{max} > T_2\ C_{min}$. Instead, in FIG. 7, $T_1\ C_{max} < T_2\ C_{min}$ and so direct connection between the ends of tubes $T_1$ and $T_2$ is not possible.

To secure tubes $T_1$ and $T_2$ together a connection tube $T_c$ is provided which is located inbetween tubes $T_1$ and $T_2$. The connection tube $T_c$ has a first axial end 60 of relatively small cross-sectional dimension and a second axial end 61 of relatively large cross-sectional dimension.

The cross-sectional shape and dimension of the first axial end 60 approximates to that of the end of tube $T_1$ to which it is connected and similarly the cross-sectional shape and dimension of the second axial end 61 approximates to that of the end of tube $T_2$ to which it is to be connected. This is schematically illustrated in FIG. 8.

The respective ends of tubes $T_1$, $T_c$ and $T_2$ are bonded together using conventional bonding techniques such as welding or brazing.

After joining of tubes $T_1$, $T_c$ and $T_2$, the connected tubes are deformed by hydro-forming to form element 10.

In the example illustrated in FIGS. 7 and 8 the axial length $L_J$ of tube $T_c$ has a minimum value which is determined by the difference between $T_1\ C_{max}$ and $T_2\ C_{min}$. This minimum value is represented in FIGS. 7 and 8. However, it will be appreciated that length $L_J$ may be chosen to be longer taking into consideration the amount of deformation required by tubes $T_1$ and $T_2$ during the hydro-forming stage.

Figure 2:
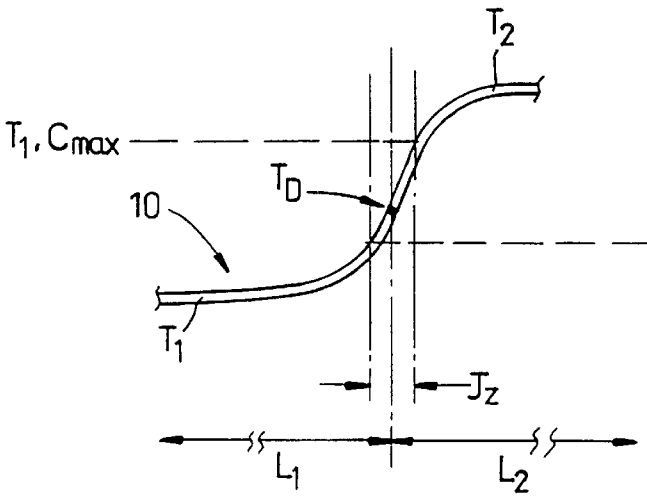
FIG. 2 is a more detailed schematic illustration of the element shown in FIG. 1 in the region of jointing between adjacent tubes.

It will also be appreciated that use of a connection tube $T_c$ is not restricted to the situation where $T_1\ C_{max} < T_2\ C_{min}$ and that a connection tube $T_c$ may be utilised in the embodiments described in relation to FIGS. 1, 2 and 3.

It will also be appreciated that any of the tube connection techniques described in relation to FIGS. 4, 5 or 6 may be used for joining tube $T_c$ to tube $T_1$ and/or tube $T_2$.

The material from which tube $T_c$ is formed may be the same or different to that used for tubes $T_1$ or $T_2$.

It will be appreciated that the cross-sectional shape of the first and second ends 60, 61 respectively of tube $T_c$ correspond to the shape of the ends of tubes $T_1$ and $T_2$ to which they are connected. However, the cross-sectional shape of the tube $T_c$ intermediate its first and second ends 60, 61 may be of any appropriate shape bearing in mind the required cross-sectional shape of element 10.

Usually connection tube $T_c$ will be of constant cross-sectional shape along its length and will progressively increase in cross-sectional dimension from end 60 to end 61. Thus, the tube $T_c$ will usually be in the form of a truncated cone.

The wall thickness of each of tubes $T_1$, $T_2$ and $T_c$ is constant along its length. The wall thickness of each tube $T_1$, $T_2$, $T_c$ may be the same or may be different.

What is claimed is:

1. A process for forming an elongate structural element of determined shape being of large and small cross-sectional dimensions at spaced locations along its length, the process including the steps of:

(i) selecting a first tube for forming a, first selected length of the element having cross-sectional dimensions within a first range of relatively small cross-sectional dimensions within the hydro-forming-elongation ratio capabilities of the material from which the first tube is formed, said first tube being of constant wall thickness and being of a first constant cross-sectional dimension along its length, (ii) selecting a second tube for forming a second selected length of the element adjacent to the first length, the second length of the element having cross-sectional dimensions within a second range of relatively large cross-sectional dimensions within the hydro-forming elongation ratio capabilities of the material from which the second tube is formed, said second tube being of constant wall thickness and being of a second constant cross-sectional dimension along its length which is different to said first constant cross-sectional dimension, (iii) joining said first and second tubes together end to end by forming an end portion of the first tube, forming an end portion of the second tube, overlapping said end portions, and fixedly securing together said overlapping end portions, and (iv) performing forming operations on the first and second tubes to produce said determined shape of the element in which the element has large and small cross-sectional dimensions at spaced locations along its length.

2. A process according to claim 1 wherein step (iv) is performed before step (iii).

3. A process according to claim 1 wherein said first and second constant cross-sectional dimensions respectively lie outside said second and first ranges of cross-sectional dimensions, and joining of said first and second tubes includes the steps of:

(v) enlarging one end of the first tube to form a first connection formation of greater cross-sectional dimension than said first constant cross-sectional dimension, or (vi) reducing one end of the second tube to form a second connection formation of lesser cross-sectional dimension than said second constant cross-sectional dimension, and (vii) joining the first and second connection formations together to join said first and second tubes together.

4. A process according to claim 1 wherein in step (iv) at least one of the tubes is deformed using hydro-forming techniques.

5. A process according to claim 1 wherein the first and second tubes are formed from the same material and are of the same or different wall thickness.

6. A process according to claim 1 wherein the first and second tubes are formed from different materials and are of the same or different wall thickness.

7. A process for forming an elongate structural element of predetermined shape being of large and small cross-sectional dimensions at spaced locations along its length, the process including the steps of:

(i) selecting a first tube for forming a first selected length of the element having cross-sectional dimensions within a first range of relatively small cross-sectional dimensions within the hydro-forming-elongation ratio capabilities of the material from which the first tube is formed, said first tube being of a first constant cross-sectional dimension along its length, (ii) selecting a second tube for forming a second selected length of the element adjacent to the first length, the second length of the element having cross-sectional dimensions within a second range of relatively large cross-sectional dimensions within the hydro-forming-elongation ratio capabilities of the material from which the second tube is formed, said second tube being of a second constant cross-sectional dimension along its length which is different to said first constant cross-sectional dimension, (iii) selecting an intermediate connection tube having a first end of relatively small cross-sectional dimension and a second end of relatively large cross-sectional dimension;

(iv) joining said first and second tubes together by connecting one end of the first tube to the first end of the connection tube and by connecting one end of the second tube to of the second end of the connection tube, said joining of said one end of the first tube to the first end of the connection tube and/or said joining of said one end of the second tube to the second end of the connection tube including forming overlapping end portions which are fixedly secured together, and (v) performing forming operations on the first, second and connection tubes to produce said predetermined shape of the element in which the element has large and small cross-sectional dimensions at spaced locations along its length.

8. A process according to claim 7 wherein the first, second and connection tubes are formed from the same material and are of the same or different wall thickness.

9. A process according to claim 7 wherein the first, second and connection tubes are formed from different material and are of the same or different wall thickness.

10. A process according to claim 7 wherein the overlapping end portions are secured together by welding.

11. A process according to claim 7 wherein the overlapping end portions are secured together by mechanical fixing.

12. A process according to claim 7 wherein the overlapping end portions are secured together by bonding.

13. A process according to claim 7 wherein a layer of friction material is located inbetween said overlapping end portions.

14. A process for forming an elongate structural element of determined shape being of large and small cross-sectional dimensions at spaced locations along its length, the process including the steps of:

(i) selecting a first tube for forming a first selected length of the element having cross-sectional dimensions within a first range of relatively small cross-sectional dimensions within the hydro-forming-elongation ratio capabilities of the material from which the first tube is formed, said first tube being of constant wall thickness and being of a first constant cross-sectional dimension along its length, (ii) selecting a second tube for forming a second selected length of the element adjacent to the first length, the second length of the element having cross-sectional dimensions within a second range of relatively large cross-sectional dimensions within the hydro-forming elongation ratio capabilities of the material from which the second tube is formed, but outside the hydro-forming elongation ratio capabilities of the material from which the first tube is formed, said second tube being of constant wall thickness and being of a second constant cross-sectional dimension along its length which is different to said first constant cross-sectional dimension, (iii) joining said first and second tubes together end to end by forming an end portion of the first tube, forming an end portions of the second tube, overlapping said end portions, and fixedly securing together said overlapping end portions, and (iv) performing forming operations on the first and second tubes to produce said determined shape of the element in which the element has large and small cross-sectional dimensions at spaced locations along its length.

15. A process for forming an elongate structural element of determined shape being of large and small cross-sectional dimensions at spaced locations along its length, the process including the steps of:

(i) selecting a first tube for forming a first selected length of the element having cross-sectional dimensions within a first range of relatively small cross-sectional dimensions within the hydro-forming-elongation ratio capabilities of the material from which the first tube is formed, said first tube being of a first constant cross-sectional dimension along its length, (ii) selecting a second tube for forming a second selected length of the element adjacent to the first length, the second length of the element having cross-sectional dimensions within a second range of relatively large cross-sectional dimensions within the hydro-forming-elongation ratio capabilities of the material from which the second tube is formed, but outside the hydro-forming elongation ratio capabilities of the material from which the first tube is formed, said second tube being of a second constant cross-sectional dimension along its length which is different to said first constant cross-sectional dimension, (iii) selecting an intermediate connection tube having a first end of relatively small cross-sectional dimension and a second end of relatively large cross-sectional dimension;

(iv) joining said first and second tubes together by connecting one end of the first tube to the first end of the connection tube and by connecting one end of the second tube to the second end of the connection tube, said joining of said one end of the first tube to the first end of the connection tube and/or said joining of said one end of the second tube to the second end of the connection tube including forming overlapping end portions which are fixedly secured together, and (v) performing forming operations on the first, second and connection tubes to produce said determined shape of the element.

* * * * *